US006567766B2

(12) United States Patent
Johansson et al.

(10) Patent No.: US 6,567,766 B2
(45) Date of Patent: May 20, 2003

(54) METHOD FOR A FIBER PROCESSING APPARATUS

(75) Inventors: Ola M. Johansson, Brookfield, WI (US); Dennis L. Konkol, Hartland, WI (US)

(73) Assignee: J & L Fiber Services, Inc., Waukesha, WI (US)

( * ) Notice: Subject to any disclaimer, the term of this patent is extended or adjusted under 35 U.S.C. 154(b) by 0 days.

(21) Appl. No.: 09/995,369

(22) Filed: Nov. 27, 2001

(65) Prior Publication Data

US 2002/0049564 A1 Apr. 25, 2002

Related U.S. Application Data

(63) Continuation of application No. 09/237,340, filed on Jan. 25, 1999, now Pat. No. 6,324,490.

(51) Int. Cl.[7] ..... G06F 9/00

(52) U.S. Cl. ..... 702/184; 702/183; 702/193; 702/198

(58) Field of Search ..... 702/183, 184, 702/193, 198; 209/411, 395

(56) References Cited

U.S. PATENT DOCUMENTS 5,132,920 A * 7/1992 Bellows et al. ..... 364/551.01
5,293,556 A * 3/1994 Hill et al. ..... 364/551.01
5,791,495 A * 8/1998 Gero et al. ..... 209/395
6,021,905 A * 2/2000 Frejborg ..... 209/411
6,324,490 B1 * 11/2001 Johansson et al. ..... 702/184

* cited by examiner

*Primary Examiner*—Marc S. Hoff
*Assistant Examiner*—Felix Suarez
(74) *Attorney, Agent, or Firm*—Boyle Fredrickson Newholm Stein & Gratz S.C.

(57) ABSTRACT

A system, software program, and method for monitoring performance of a fiber processing apparatus that preferably is a disk refiner or a filter screen that analyzes operating data pertaining to apparatus operation to determine when a plate of the apparatus should be replaced before plate wear undesirably affects performance. Operating data over time is analyzed to determine whether it exhibits a trend characteristic of plate wear.I If so, a plate change recommendation is generated. To avoid fluctuations in performance not due to plate wear from affecting the determination, operating data over several hours of apparatus operation is analyzed. When a plate is changed, an inventory of the plates is updated. If the inventory requires replenishing, plates are ordered over a telecommunications link with a remote supplier computer or system. New replacement plates can be entered into the inventory from information downloaded from a portable input device.

24 Claims, 9 Drawing Sheets

114
START
118
140
UPDATE PLATE INVENTORY?
NO
YES
142
PLATE(S) BEING ADDED TO INVENTORY?
YES
NO
144
INPUT PLATE(S) INTO INVENTORY
146
UPDATE INVENTORY OF PLATE(S)
154
UPDATE REFINER TO REFLECT INSTALLED PLATE(S)
152
UPDATE REFINER TO REFLECT REMOVED PLATE(S)
164
ORDER PLATE(S)?
NO
YES
166
ORDER PLATE(S)
148
IS INVENTORY BEING CHANGED?
YES
NO
150
PLATE(S) BEING INSTALLED ON A REFINER?
YES
NO
TO FIG. 8B

METHOD FOR A FIBER PROCESSING APPARATUS

CROSS REFERENCE TO RELATED APPLICATION

This application is a continuation application of presently U.S. application Ser. No. 09/237,340, filed Jan. 25, 1999 and entitled "Monitoring System and Method For A Fiber Processing Apparatus," now U.S. Pat. No. 6,324,490, the entirety of which is incorporated herein by reference.

FIELD OF THE INVENTION

The present invention relates to a system and method of monitoring a fiber processing apparatus that preferably is a disk refiner or a filter screen that can also manage apparatus inventory.

BACKGROUND OF THE INVENTION

In fibrous product processing, such as the process used to make paper, fibers, such as wood fibers and cloth fibers, are separated and mixed with water and, if desired, other ingredients to form a fibrous stock slurry. This slurry is passed through a filter or a screening apparatus, typically referred to as a filter screen, a pressure screen, or a screen cylinder, that filters the slurry to remove from the slurry large particles, such as rocks, stones, metal fragments and the like, unrefined or untreated fiber, improperly sized fiber, as well as other contaminants. After filtering the slurry at least somewhat, the slurry is introduced to a refiner, typically a disc refiner, that grinds or abrades the fibers so they become more frayed or fibrillated. These frayed fibers are beneficial because they interlock with each other during manufacturing of the fiber product to produce a stronger fiber product. For example, where paper is being manufactured, frayed fibers beneficially increase the tensile and tear strength of the paper.

An example of a disc refiner is shown and disclosed in U.S. Pat. No. 5,425,508. The refiner has at least one pair of opposed ridged ring-shaped metal refiner plates that can be formed of pie-shaped refiner plate segments. During operation, one of the refiner plates rotates relative to the other of the refiner plates while the slurry flows under relatively high pressure into a gap between the plates where the plates grind or abrade the fibers.

As one would expect, the refiner plates, or segments of the plates, wear over time which can dramatically decrease the quality of the refining action, i.e. refiner performance, such that the fibers are less frayed than desired. While various parameters of refiner operation are usually monitored, it is believed not heretofore known to collectively monitor and analyze at least some of these parameters while a refiner is operating to attempt to detect or predict when the performance or a refiner plate (or plates) has degraded to the point that that the refiner plate, or segments of the plate, should be replaced. This is because many things other than plate wear can cause the performance of a refiner to at least temporarily decrease making it extremely difficult to detect when plate wear is primarily responsible. Examples of some things that can cause refiner performance to temporarily drop include non-fibrous matter in the stock slurry, a change in stock consistency, knots, and a change in the type or size of fibers being processed.

As a result of the uncertainty of what is responsible for a decrease in refiner quality or performance, refiner plates are typically replaced according to a schedule that mandates replacement after a certain number of hours of operation whether or not replacement is really needed. For example, a typical thermomechanical pulp (TMP) mill may require replacement of the primary plates of a refiner after 2,200 hours of operation and the reject plates of the refiner after 650 hours of operation, regardless of how well the refiner is performing. Because of this, refiners may operate at a less than optimum quality or performance level with plates that needed to be replaced earlier than dictated by the replacement schedule. In other instances, refiner plates that don't need replacing are unnecessarily replaced in accordance with the replacement schedule causing needless downtime and wasting money.

The same is true for filter screens. As is disclosed in U.S. Pat. Nos. 4,954,249; 5,718,826; and 5,626,235, although filter screens can have other configurations, filter screens are often made of perforated and generally cylindrical screen plates, usually referred to as cylinder screens, that are held together by a frame that typically includes retaining rings and tie rods. Typically, two or more such screen plates are disposed end-to-end in a housing, forming a generally cylindrical screen assembly, with the plates held together by the tie rods that extend axially alongside the plates and which pass through the retaining rings.

Each screen plate is formed from metal wire, i.e. wedgewire, or from machined metal sheets. Each screen plate is perforated by holes that typically are slots of a predetermined size that permits objects in the slurry of a size smaller than one of the slots and liquid to pass through the plate. The material retained, referred to as rejects, is drawn away from the surface of the screen plate usually by the head of a moving foil that is located adjacent the screen assembly. The rejects are directed from the filter screen out a discharge port for disposal.

To help ensure that only the slurry is made up of only refined fibers and liquid when it reaches a fiber product processing machine, such as a paper machine, the slurry often passes through several stages of filter screens. Each filter screen typically has correspondingly smaller and smaller holes or slots such that it is possible to limit the size of the fibers that actually arrive at the fiber product-processing machine.

Unfortunately, screen plates wear rather slowly during operation and then rapidly degrade in performance in a rather short time, which makes screen plate failure difficult to predict. To prevent screen plate wear from adversely impacting the fiber product manufacturing process, screen plates are also changed according to a schedule. While the flow rate of the slurry through a particular filter screen can be monitored to provide some sort of an estimate of filter screen efficiency or quality, it is believed heretofore not known to collectively monitor and analyze this and other filter screen operating parameters to attempt to detect or predict when the performance of a screen plate has degraded to the point that it needs to be replaced.

Finally, because fiber product manufacturing processes often operate around the clock seven days a week, an inventory of replacement refiner plates and screen plates are usually kept nearby. Unfortunately, keeping an inventory of these plates takes up valuable and costly space that could be devoted to other more efficient aspects of fiber product production.

Therefore, what is needed is a system and method of managing an inventory of one or both refiner plates and screen plates that minimizes the storage space required at or nearby the fiber product manufacturing plant. What is also needed is a system and method of monitoring refiner performance to detect and preferably indicate when one or more plates of a refiner should be replaced. What is further needed is a system and method of monitoring filter screen performance to detect and preferably indicate when one or more screen plates of a filter screen should be replaced. What is still further needed is a system and method of monitoring refiners and filter screens to detect when one or more plates need to be replaced.

SUMMARY OF THE INVENTION

A system, software program, and method of monitoring operation of a fiber processing apparatus that preferably is either or both a refiner and a filter screen. The system includes a computer that is linked to a plurality of sensors that sense data that pertains to the operation of at least one fiber processing apparatus. The computer is configured with a program that monitors operating data pertaining to the operation of a fiber processing apparatus to help determine, estimate or predict about when a plate of the apparatus should be changed.

The operating data over a period of time of apparatus operation is monitored for a change in the data that indicates a trend toward reduced apparatus performance. The change is analyzed to determine whether it is attributable to plate wear or other factors not related to plate wear. If it is determined that the change is due to plate wear, a recommendation to replace the plate is generated.

In determining whether the change is due to plate wear, the operating data can be analyzed to detect whether performance has fallen below a threshold that indicates the plate should be changed. In one preferred method of determining whether to change the plate, a set of operating data over time is analyzed by a regression technique to determine whether a result or characteristic of the regression technique compared against the threshold indicates the change in data is due to plate wear.

In one preferred regression technique, linear regression or piecewise linearization is used to obtain a slope, an operating slope, of the operating data. The operating slope is compared with a threshold slope to determine whether the operating slope is within a certain acceptable window of the threshold slope that indicates that apparatus performance has not degraded sufficiently so as to warrant a recommendation to replace the plate. If the operating slope is outside the acceptable window, the recommendation to replace the plate is generated. In one preferred implementation, a plate change recommendation is generated if the slope is negative. In another preferred implementation, the plate change recommendation is generated if the slope is not within about 10% or 20% of the threshold slope.

The threshold slope is a slope of operating data taken at a time prior to at least some of the data upon which the operating slope is based. In one preferred implementation, the threshold slope is determined from a baseline obtained about when or shortly after the plate was first installed. In another preferred implementation, the threshold slope can be a prior operating slope or can be the slope from a set of data taken shortly before determining the operating slope. The threshold slope is based on data sufficient to provide a baseline from which change can be detected. If desired, the threshold slope can simply be a predetermined value that can be user defined.

To avoid transient fluctuations in data and apparatus performance from falsely triggering a plate change recommendation, data is taken over a large enough sampling period so as to filter out the fluctuations. For example, because the decline in performance of a refiner plate usually happens over a period of about one hundred hours, refiner-related data taken for a time of at least about the most recent fifty hours of refiner operation and no greater than about the most recent two hundred hours of refiner operation is used to determine the operating slope. In another example, because the decline in performance of a filter screen plate happens much more rapidly, typically within about an eight hour period, filter screen-related data is taken for a period of time of at least about the most recent four hours of filter screen operation and no greater than about the most recent twenty-four hours of filter screen operation is used to determine the operating slope.

In a preferred method of managing an inventory of fiber processing apparatus plates, the inventory is updated when one or more plates are added to the inventory or if one or more plates are removed from the inventory. Plates added to the inventory, such as when a shipment of plates are received, can be provided from a portable device that inputs or scans plate identification information of a tag of the plate being inventoried. The portable device is linked to the computer and the plate identification information is downloaded to the computer.

Plates removed from the inventory typically are removed when they are installed on a fiber processing apparatus. When a plate is installed on an apparatus, a record for that apparatus is updated to reflect the installed plate and to reflect that a different plate was removed from the apparatus. Each apparatus being monitored by the computer preferably has such a record. The plate removed goes to another record that keeps track of removed plates.

The inventory is monitored to determine whether the number of plates in the inventory has fallen below a desired threshold or below a desired threshold for a particular fiber processing apparatus. If so, replacement plates are automatically ordered preferably by a link to a remote computer that provides the order to a supplier of plates. Preferably, the link is a telecommunications link that permits the order to be placed by e-mail or by FTP connection with the supplier computer.

When an order is placed, confirmation of the order from the supplier computer preferably is received while the link with the supplier computer is established. If desired, the order confirmation can be displayed or printed.

It is an object of the present invention to more accurately detect when plate wear will or is about to so adversely affect performance of the fiber processing apparatus that it should be changed.

It is an advantage of the present invention that more accurate detection of plate wear enables plate use to be extended reducing plate replacement costs.

It is an object of the present invention to detect plate wear at an early enough stage before it significantly impacts the quality of the fiber-based product being produced.

It is an advantage of the present invention that it optimizes fiber processing by minimizing the impact of plate wear.

It is another object of the invention to filter out transient changes in performance unrelated to plate wear to maximize the useful life of the plate.

It is another advantage of the present invention that transient changes in performance are filtered to prevent them from triggering a plate change.

It is another object of the present invention to conveniently monitor operation and performance of more than one fiber processing apparatus that can be located in more than one place using a minimum of labor thereby saving money, time and labor.

Other objects, features, and advantages of the present invention include: a monitoring system that can advantageously interface with an existing fiber processing apparatus data acquisition system such as a paper mill's distributed control system (DCS), a monitoring system that is capable of both monitoring apparatus performance while also maintaining and managing inventory of plates for the apparatus; that reduces fiber processing apparatus downtime; that maximizes fiber processing quality; that is flexible in that it can have thresholds that trigger a plate change recommendation that can be user defined, can be different for different types of refiners and filter screens, and can be adjusted for changes in a refiner or filter screen; and is a system and software program that is simple, flexible, reliable, and robust, and which is of economical manufacture and is easy to assemble, install, and use.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE INVENTION

Figure 1:
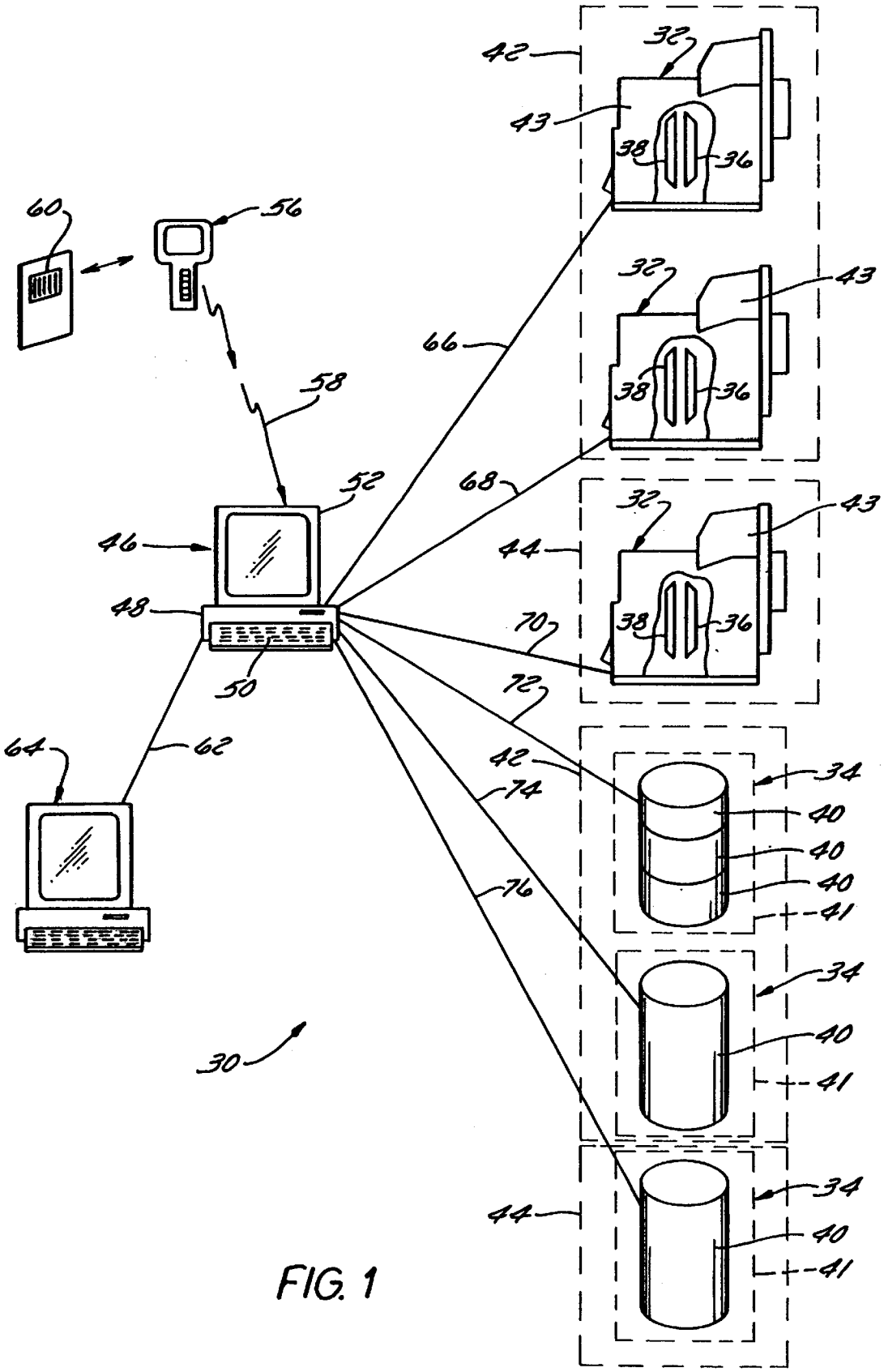
FIG. 1 is a schematic view of a monitoring and inventorying system of the invention.
Figure 2:
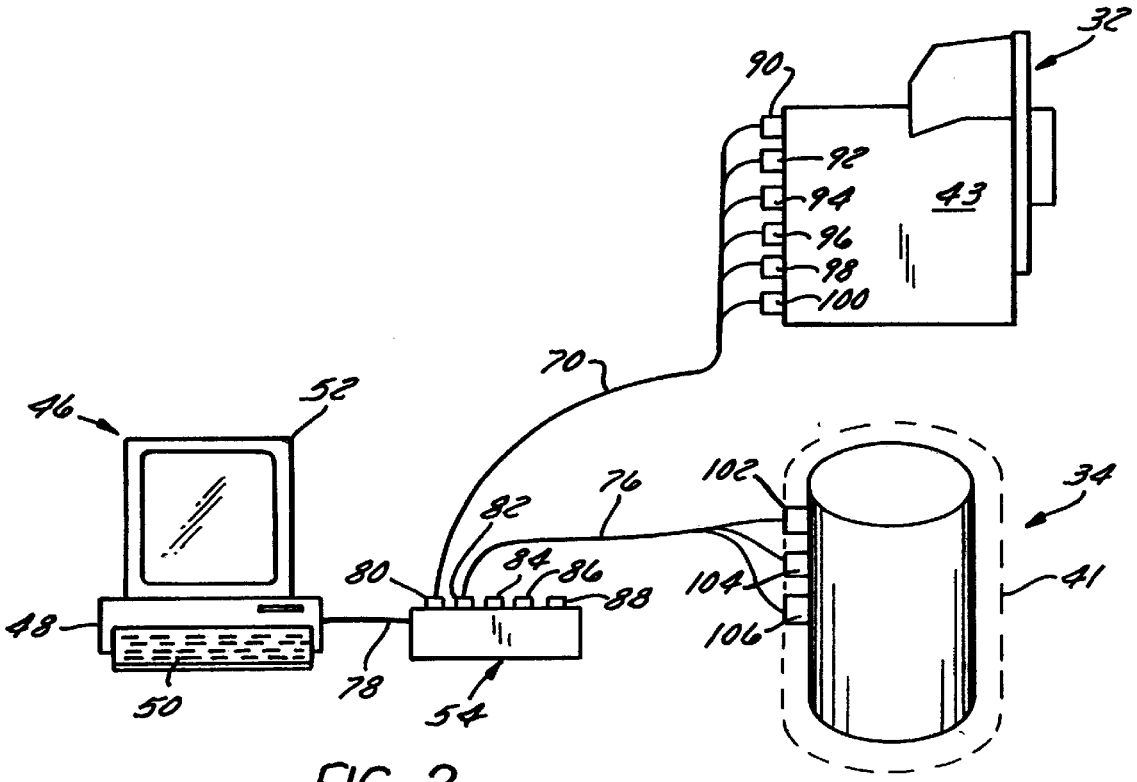
FIG. 2 is a schematic view showing a host computer linked to sensors of a refiner and a filter screen.

FIGS. 1 and 2 illustrate a system 30 of this invention for monitoring operation of at least one disc refiner 32, at least one filter screen 34, or a combination of at least one refiner 32 and at least one filter screen 34 to detect and indicate when performance of the refiner 32 or the filter screen 34 has degraded such that one or more of its plates 36, 38 or 40 must be changed. Preferably, the system 30 of this invention is capable of monitoring, substantially simultaneously or in sequence, a plurality of refiners 32, a plurality of filter screens 34, or a plurality refiners 32 and a plurality filter screens 34. Advantageously, the system 30 of this invention is also capable of monitoring refiners 32 and/or filter screens 34 located in two or more different fiber processing plants 44. In another preferred feature of the system 30 of this invention, the system 32 can be configured to help manage an inventory of plates 36, 38 and/or 40 and order replacement plates 36, 38 and/or 40 in an automated manner when additional plates 36, 38 and/or 40 are needed.

Figure 3:
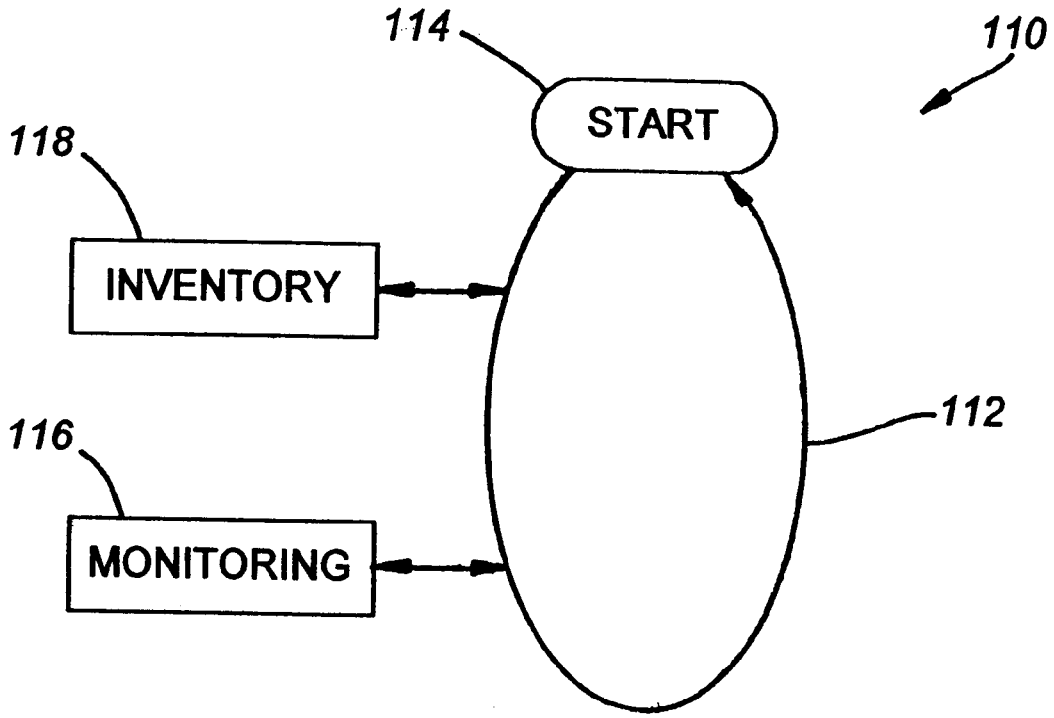
FIG. 3 is a flow chart of a method of the invention.
Figure 4:
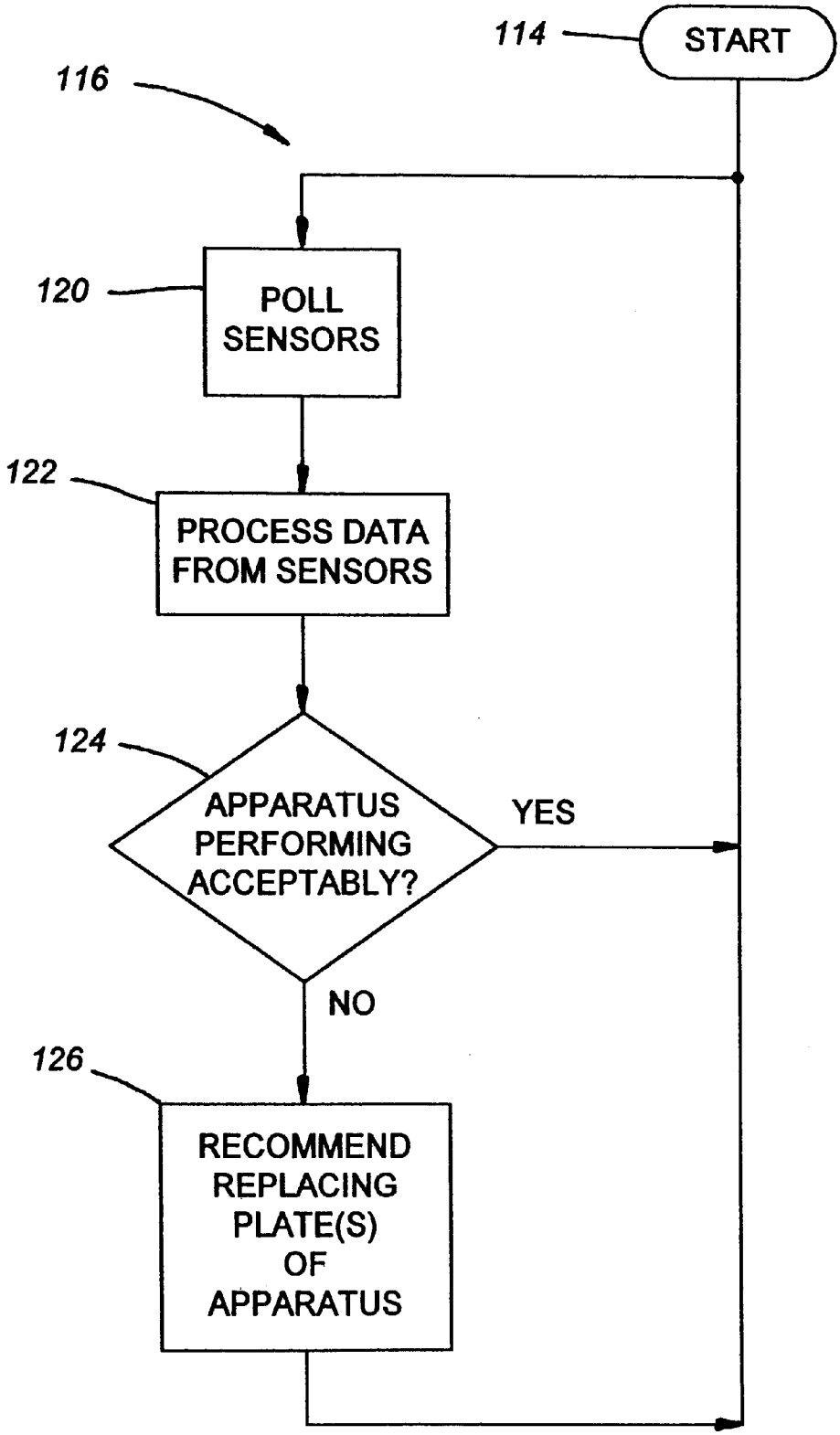
FIGS. 4–5 are flow charts of a method for monitoring refiner/filter screen operation.
Figure 5:
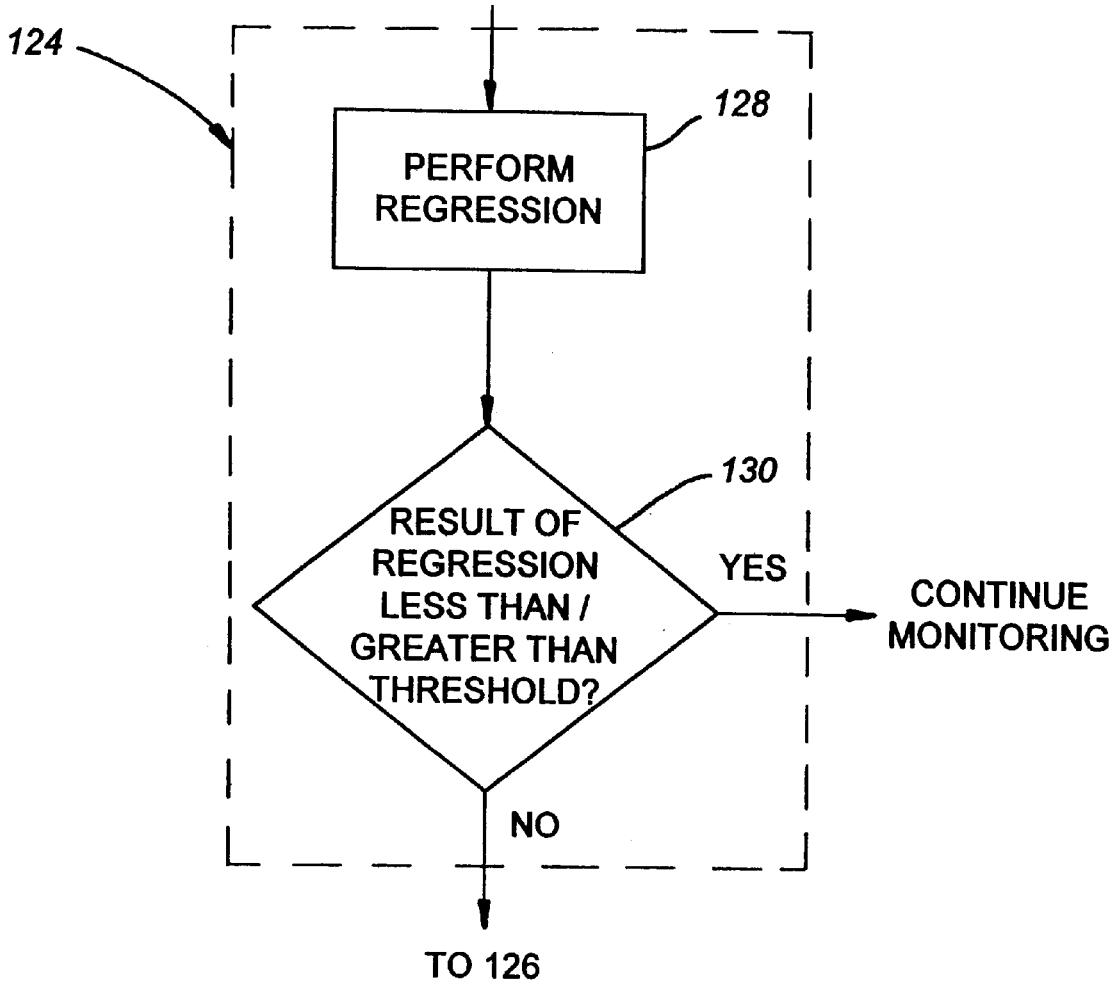

The system includes a host computer 46, such as a personal computer or the like, capable of executing a software program of this invention, preferred flowcharts of which are shown in FIGS. 3–5, that is capable of analyzing the performance of one or more refiners 32, one or more filter screens 34, or one or more refiners 32 and one or more filter screens 34 to detect and indicate when one or more of their plates 36, 38 and 40 should be replaced. The computer 46 is shown in FIG. 1 linked to a plurality of pairs of refiners 32 and a plurality of pairs of filter screens 34 such that a plurality of variables each related to the operation of each refiner 32 and a plurality of variables each related to the operation of each filter screen 34 can be monitored.

The main unit 48 of the host computer 46 preferably houses at least one on-board processor linked to memory, such as on-board random-access memory or the like, and can also be linked to a storage device, such as a disk drive or the like. The computer 46 also has at least one input device, such as a keyboard 50, can have a mouse or another pointing device, and preferably has a display 52. As is shown in more detail in FIG. 2, the computer 48 preferably also has one or more means for acquiring data 54 including at least one data acquisition device or a data acquisition system capable of receiving data from one or more refiners and/or one or more filter screens. Such data acquisition means 54 can be a separate component linked to the computer 46 and the refiners 32 and/or filter screens 34 but can comprise a distributed control system (DCS) (or an interface with a DCS) at the fiber processing plant or fiber product manufacturing plant that is linked to the refiners 32 and filter screens 34.

Referring again to FIG. 1, to enter inventory of replacement plates, such as refiner plates 36 and 38, refiner plate segments, or screen plates 40, a separate input device 56 can be used. In one preferred embodiment, the input device 56 is portable such that it can easily be carried by a person from one location to another location. Example of suitable input devices 56 that are portable include handheld computers, personal digital assistants, and notebook, laptop or subnotebook computers. Other types of input devices can be used. As is depicted by line 58, the input device 56 can be directly linked to the host computer 46, such as by a cable, a cradle, a network, or the like, or indirectly linked, such as by an infrared link or a radio-frequency (RF) link.

While entry of the inventory data for a particular plate or plate segment, depicted in an exemplary manner by reference numeral 38, can be done manually, such as by keying in the data, it preferably is done in an automated manner, such as through the use of the input device 56, or another device linked to the input device, sensing a tag 60 of the plate 38. Such a tag 60 can be a label applied to the plate 38 but can be something other than a label and can be a separate or integral part of the plate 38. One preferred example of a suitable tag 60 is a bar code label that is sensed by the input device 56, such as by optical scanning. Other types of tags 60 can be used including, for example, magnetic tags, transponders, or optically readable labels, such as holograms, masks, or the like.

In one preferred system embodiment, the input device 56 comprises a bar code scanner that scans a bar code label 60 attached to the plate 38. The scanner 56 preferably has a memory storage capable of storing at least several, if not several hundred or several thousand, inventory entries that are later downloaded to the host computer 46 when it is linked to the computer 46.

To order replacement plates 36, 38 and/or 40 in an automated manner to replenish inventory, the host computer 46 can be connected by a link 62 to another computer 64 that preferably is a supplier computer 64 located remote from the host computer 46 and that preferably is located at or in communication with a supplier of plates. Such a supplier can be a sales representative, a distributor, a retailer, or a manufacturer of the plates that is located at a site remote from the site of the host computer 46. The two computers 46 and 64 preferably are linked, at least from time to time, preferably by a telecommunications link 62, such that one computer can communicate with the other the computer. In one type of preferred link 62, the host computer 46 communicates by e-mail with the supplier computer 62 to order additional replacement plates. In another preferred type of link 62, the host computer 46 communicates with the supplier computer 64 via a file transfer protocol (FTP) link over the Internet. In a still further type of link 62, the host computer 46 communicates by a telecommunications link, preferably by telephone, with a bulletin board system (BBS) of the supplier. In still another type of link 62, the link is a fax link.

In a preferred system arrangement, the monitoring computer 46 is directly or indirectly connected by links, indicated by reference numerals 66–76 in FIG. 1, to refiners 32 and to filter screens 34. For example, one or more of the links 66–76 can be a cable between each refiner 32 and the computer 46 and each filter screen 34 and the computer 46. If desired, the computer 46 can be part of or interface with a network that is in communication with the refiners 32 and the filter screens 34. An example of such a network used in paper mills, including newsprint paper mills, is a DCS. If desired, the network can be partially or totally wireless.

The refiner 32 can be a refiner of the type used in thermomechanical pulping, refiner-mechanical pulping, chemithermomechanical pulping, or another type of pulping or fiber processing application. The refiner 32 can be a counterrotating refiner, a double disc or twin refiner, or a conical disc refiner known in the industry as a CD refiner. Examples of refiners 32 that can be used with the system and method of the invention are disclosed in more detail in U.S. Pat. Nos. 5,823,453, and 5,425,508, the disclosures of which are hereby expressly incorporated herein by reference.

The filter screen 34 can be a horizontal or vertical filter screen each having one or more screen plates 40 arranged in a cylinder or which can be flat. As is shown in FIGS. 1 and 2, the plates 40 are received in a housing 41 shown in phantom. Examples of filter screens 34 that can be used with the system and method of the invention are disclosed in more detail in U.S. Pat. Nos. 4,954,249; 5,718,826; and 5,626,235, the disclosures of which are each expressly incorporated herein by reference.

The link 70 between the host computer 46 and one of the refiners 32 and the link 76 between the computer 46 and one of the filter screens 34 is shown in more detail in the schematic of FIG. 2. The computer 46 is connected by a link 78 to a data acquisition system 54, or is further comprised of a data acquisition system 54 that can be internal to or integral with the computer 46. In one preferred embodiment, the data acquisition system 54 is comprised of a plurality of data acquisition cards 80–88, or data acquisition modules, each having one or more links to a sensor of the refiner 32 and/or the filter screen 34. If desired, the data acquisition system 54 can be comprised of one or more data acquisition cards installed in slots inside the computer 46. While FIG. 2 depicts a link from a refiner 32 or a filter screen 34 running to a single card or module, a single card or module can have two or more links.

Examples of suitable data acquisition cards or modules include one or more of the following: a model 118 series analog-to-digital data acquisition card marketed by Sensoray of 7337 SW Tech Center Drive, Tigard, Oreg., a model SIG32C-8 digital signal processing multichannel board, a model ADC64 high-speed multichannel board, a model Sig56-2 low cost measurement board, and/or a MOTOROLA EVM56xxx series board, all four of which are marketed by Signalogic of 9617 Wendell of Dallas, Tex., a model 5516DMA data acquisition board marketed by ADAC Corporation of 70 Tower Park, Woburn, Mass., and/or a CIO-DAS16/440I analog-to-digital board, a D1000 or D2000 series modular digital transmitter with RS-232 or RS485 output(s), and/or an ADC-16 8-channel high resolution analog input board for IBM compatibles, all three of which are marketed by Omega Engineering, Inc., of One Omega Drive, Stamford, Conn. Of course, other data acquisition boards, modules, and devices can be used.

Examples of suitable data acquisition systems include a DATASHUTTLE Series DS-12 or DS-16 portable data acquisition system, a DATASHUTTLE EXPRESS high speed portable data acquisition system, an INSTRUNET series PCI data acquisition system, an OMB-LOGBOOK-300 stand-alone personal-computer data acquisition system, all of which are marketed by Omega Engineering, Inc. Other data acquisition systems can be used.

As is schematically represented in FIG. 2, there are a plurality of sensors associated with each refiner 32 and filter screen 34 being monitored with at least some of the sensors ultimately linked to or in communication with the data acquisition system 54.

With regard to the refiner 32 schematically depicted in FIG. 2, a first sensor 90 enables the power output of the main motor of the refiner 32 to be determined. Although the sensor 90 is schematically depicted in FIG. 2 as being carried by the refiner housing 43, such a sensor 90 preferably comprises a current transformer coupled to the refiner motor or a power input shaft of the refiner 32 whose voltage or output signal is converted to a value from which the power output is determined. Thus, the sensor 90 can further include a current or voltage sensor that is in communication with the transformer, if desired. Other types of sensors can be used.

A second sensor 92 preferably comprises a force sensor that senses the applied force of at least one of the refiner plates 36 or 38 of the refiner 32 urging that plate toward the other refiner plate. A third sensor 94 preferably also comprises a force sensor that senses the applied force of the other plate. Although the sensors 92 and 94 are schematically depicted in FIG. 2 as being carried by the refiner housing, such sensors 92 and 94 can comprise accelerometers in communication with each plate, one or more strain gauges on the shaft of each rotating refiner plate, or a pressure sensor that senses the hydraulic pressure being applied to urge one of the plates toward the other of the plates. Other types of pressure sensors can be used.

A fourth sensor 96 enables the gap between the refiner plates 36 and 38 to be sensed or measured and can be a sensor 96 that enables the plate gap to be indirectly or directly sensed or measured. An example of a suitable indirect gap sensor is an inductive sensor such as a differential transformer that is carried by at least one of the refiner plates 36 or 38. Another example of a suitable gap sensor 96 is a Hall effect sensor, part of which is disposed in one of the refiner plates and exposed toward the other of the plates. Other types of refiner plate gap sensors can be used.

A fifth sensor comprises a sensor 98 that enables a determination of the rate of flow of dilution water added to the fibrous stock slurry during refining to replace water in the slurry that vaporizes, i.e. turns to steam, during refining. Although schematically shown carried by the refiner housing, the fifth sensor 98 preferably is a flowmeter that is in communication with the flow of dilution water added to the slurry that comes from a pipe. The pipe typically introduces the dilution water at the refiner plates 36 and 38 or upstream of the plates 36 and 38.

Another refiner-related sensor 100 that can be monitored can be a consistency sensor or arrangement of sensors from which consistency is determined or estimated. Included in such an arrangement of sensors 100 is a sensor that senses rotation of a conveyor screw, typically in revolutions per minute (rpm), used to introduce wood chips or pulp into that part of the stock system that ultimately travels through the refiner. The sensor arrangement 100 can further comprise one or more of the following sensors that are in communication with the flow of the slurry: a paddle-wheel type consistency sensor, an optical consistency sensor, or a viscosity meter.

A number of these refiner-related sensors and other sensors that can be monitored by the system 30 of this invention are disclosed in more detail in one or more of U.S. Pat. Nos. 4,148,439; 4,184,204; 4,626,318; 4,661,911; 4,820,980; 5,011,090; 5,016,824; 5,491,340; and 5,605,290, the disclosures of each of which are expressly incorporated herein by reference.

With regard to the filter screen 34 depicted in FIG. 2, a first sensor 102 preferably senses or measures the flow of the slurry through the screen 34 and preferably comprises a flowmeter. Where applicable, the sensor 102 can comprise a sensor arrangement 102 that can include one or more flow rate sensors that sense or measure the feed flow into the screen 34, the accept flow out of the screen 34, the reject flow out of the screen 34, and the dilution water flow, where dilution water is added.

A second sensor or arrangement of sensors 104 can be constructed and arranged to sense or measure the pressure drop of the slurry across the filter screen 34 and can comprise, for example, an upstream pressure sensor that senses pressure upstream of the screen 34 and a downstream pressure sensor downstream that senses pressure downstream of the screen 34. In one preferred arrangement, one of the pressure sensors of the arrangement 102 senses the pressure of the feed flow into the screen 34 and the other of the pressure sensors senses the pressure of the accept flow out of the screen 34. Where applicable, the arrangement 102 can include one or more additional pressure sensors that sense the pressure of the reject flow out of the screen 34 and that sense the pressure of the dilution water flow, where dilution water is added.

A third sensor or sensor arrangement 106 preferably can be used to sense or measure the consistency of the slurry such as by measuring its dry-to-wet content. The sensor 106 can be a paddlewheel-type consistency sensor or an optical consistency sensor that is mounted in the slurry line either or both upstream and downstream of the filter screen 34. Another sensor that can be used is a viscosity meter.

A method of this invention is depicted in FIGS. 3–9. The method of this invention preferably is implemented in the form of a computer program 110 that is executed by the host computer 46. Such a program 110 can be event driven, such as is depicted by the loop 112 that begins at START 114 and returns to START 114. The program 110 preferably can be exited by a key combination or by a menu selection, such as by selecting "exit" from a "file" menu of the program 110.

As is shown in FIG. 3, the program 110 has at least a monitoring branch 116 that monitors operation of refiners 32, filter screens 34, or refiners 32 and filter screens 34. The program 110 can also have an inventory branch 118 that helps monitor and manage inventory. In a preferred embodiment, the program 110 has a monitoring branch 116 and an inventory branch 118.

Referring to FIG. 4, during monitoring 116 each apparatus, i.e. refiner 32 and/or filter screen 34, is monitored by the host computer 46 preferably polling sensors 120 that pertain to the operation of the apparatus to obtain or measure data from the sensors. For example, where the apparatus is a refiner 32, the sensors polled preferably include at least one or more of sensors 90, 92, 94, 96, 98 and 100 previously discussed. Where the apparatus is a filter screen 34, the sensors polled preferably include one or more of sensors 102, 104, and 106. Each refiner 32 and/or filter screen 34 linked to the host computer 46 is repeatedly polled, preferably in sequence or one apparatus after another. If desired, the data received by the host computer 46 can come directly or indirectly from measurements made in a laboratory that pertain to operation of a refiner 32 or a filter screen 34.

The measured data, whether raw or already at least partially processed, can be assimilated by the host computer 46 such as by processing the measured data 122 of the particular apparatus into a more useful form. If desired, some or all of the processing can be performed by the data acquisition system or a data acquisition card such that data in the form of processed one or more values are provided to the computer 46 in step 122.

For example, where it is desired to determine the power output of the main refiner motor, unprocessed measured data from an associated sensor 90 can be processed to provide the power output. Likewise, unprocessed measured data from refiner sensor 92 can be processed to provide the force of one of the refiner plates, unprocessed measured data from refiner sensor 94 can be processed to provide the force of the other one of refiner plates, unprocessed measured data from the refiner gap sensor 96 can be processed to determine or estimate the gap between the plates 36 and 38, unprocessed measured data from the dilution water flowmeter 98 can be processed to provide the magnitude of dilution water added, and unprocessed measured data from a consistency sensor or sensor arrangement 100 can be processed to provide consistency.

With regard to each filter screen 34 being monitored, measured data from the flow rate sensor 102 can be processed to provide the flow rate of the slurry, unprocessed measured data from the pressure sensors 104 can be processed to provide the pressure drop, $\Delta p$, across the filter screen 34, and unprocessed measured data from consistency related sensors 106 can be processed to determine the consistency of the slurry.

After any needed processing of data measured from the sensor signals is done, as indicated by reference numeral 122, measured data is analyzed to determine whether the apparatus is performing acceptably in step 124. If it is determined that the apparatus is performing acceptably 124, monitoring of the next apparatus proceeds in sequence. In a preferred embodiment of the program 100, the program 110 preferably returns to loop 112 after monitoring one apparatus and monitoring of the next apparatus proceeds in sequence.

Preferably, data for at least the previous twenty-four hours of operation of the apparatus is stored or kept. Such data can be kept in a file that can be a database file that is accessible by the host computer 46. Preferably, data for at least the most recent four-hour period of operation is retrieved and analyzed to determine whether the apparatus is performing unacceptably such that one or more of its plates should be replaced.

If it is determined that the apparatus is not performing acceptably, a recommendation is generated in step 126 that the plate or plates of the particular apparatus be replaced. Such a recommendation 126 preferably is carried out in the form of a message that appears on the display 52 of the host computer 46. If desired, an audible alarm can be emitted when a recommendation 126 is made and the recommendation can be printed out. Monitoring of other linked apparatuses preferably continues even while the recommendation 126 is displayed. Preferably, the recommendation 126 displayed indicates exactly which apparatus needs plate replacement.

In determining whether the apparatus is performing acceptably in step 124, the data pertaining to the operation of the apparatus is stored and compared with other data that was previously stored for that particular apparatus. The data is then analyzed to determine if there is a trend that has developed that warrants recommending replacing the plates of the apparatus. The data analyzed preferably includes the data measured during the most recent monitoring cycle.

In a preferred method of analyzing the data provided from monitoring apparatus operation, regression, such as polynomial regression, is performed on the data to determine whether the data has a particular trend for a particular period of apparatus operation that indicates that the loss of performance of the apparatus is not due to any relatively transient occurrence but is due to plate wear such that the plate or plates should be changed. Preferably, the type of polynomial regression performed is linear regression, such as simple linear regression. In a preferred implementation of the method of the invention, the regression analysis is done by piecewise linearization of data in the time domain.

Referring to FIG. 5, after step 128 is performed, one or more results are analyzed to determine whether the result(s) are less than or greater than a predetermined threshold in step 130. Such a threshold preferably is a value, set of values, or criteria against which the result(s) are compared.

Figure 6:
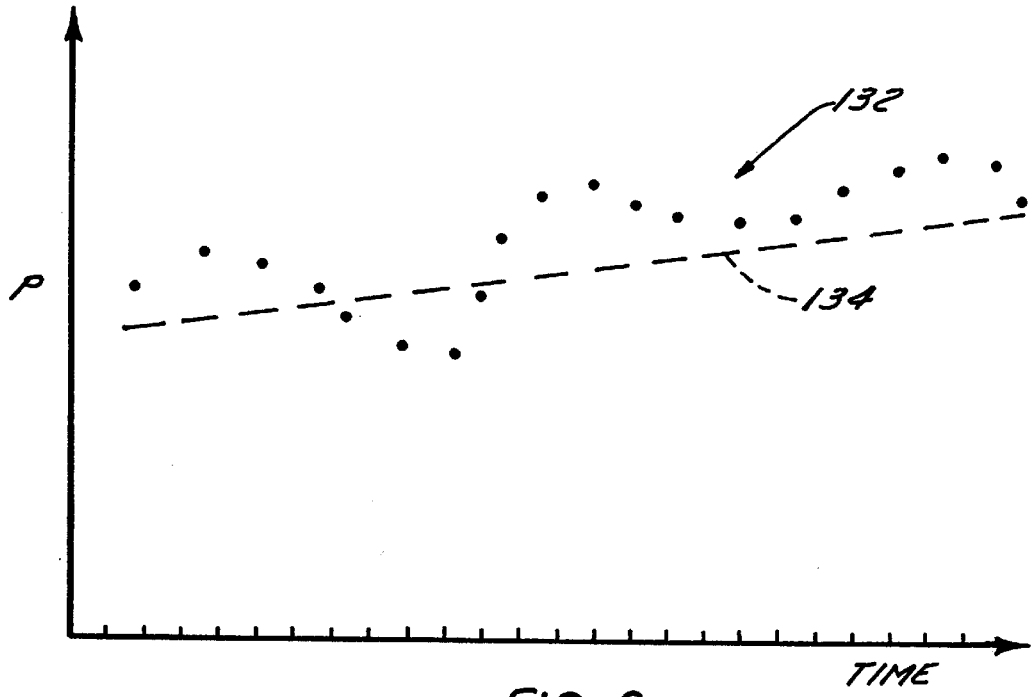
FIG. 6 is a plot of refiner or filter screen performance over operating time illustrating performance variations not due to plate wear.

FIG. 6 illustrates an exemplary plot of points of, indicated by reference numeral 132, of a set of data, P, versus apparatus operating time where there are variations in apparatus performance not due to plate wear. A representative line 134 fitted to the points, such as by using the method of least squares or by piecewise linearization, shows that the slope of the line 134 is not negative, i.e. not downward, or not sufficiently negative over time indicating any variations in apparatus performance are not due to plate wear. When a newly installed plate first begins operation, a set of such data is stored and analyzed to provide a benchmark against which later data sets are compared. Although line 134 appears to slope slightly upwardly over time a line at or about startup of a newly installed plate is generally horizontal or generally parallel to the x-axis, in this case the time axis.

Figure 7:
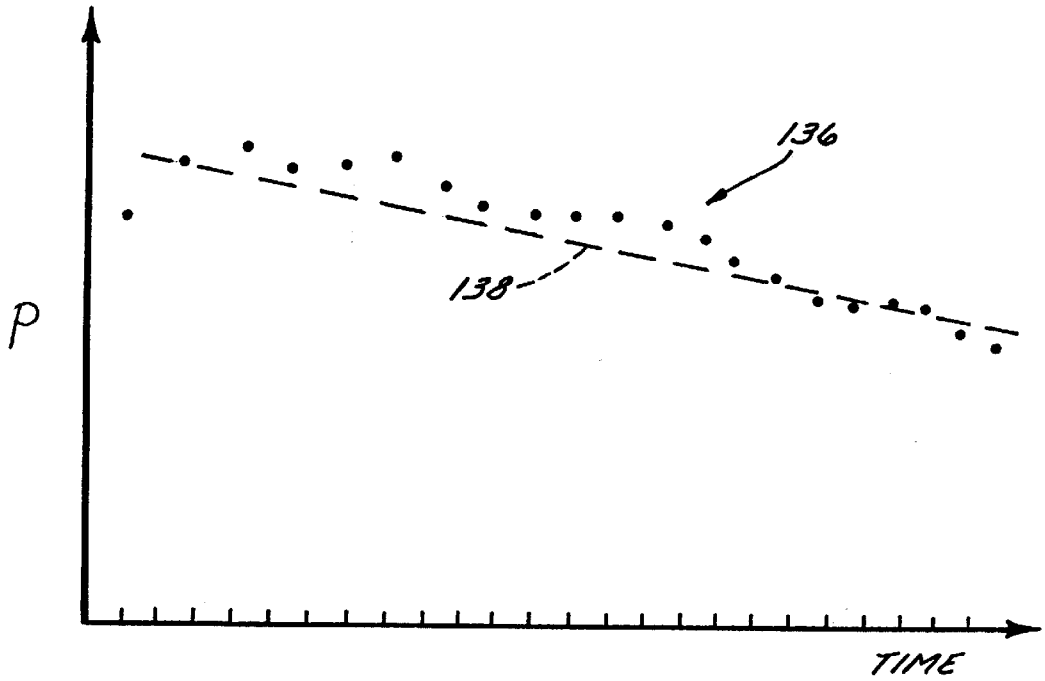
FIG. 7 is a second plot of refiner or filter screen performance over operating illustrating a decrease in performance due to plate wear.

FIG. 7 illustrates a second exemplary plot of points 136 of a set of data, P, versus operating time where apparatus performance has degraded because of plate wear such that it is recommended that one or more plates of the apparatus be changed. A representative line 138 fitted to the points shows that the slope of the line has changed relative to the slope of exemplary baseline 134 with the change in slope being sufficiently great such that it indicates a trend in apparatus performance due primarily to plate wear. In this instance, the slope of line 138 is negative, i.e. downward, or sufficiently negative in the direction of increasing time indicating a trend in apparatus performance due primarily to plate wear. The plot preferably can be displayed on the display 52, if desired but the line, as well as its slope, may simply be determined by the computer 46 without being displayed.

For example, where refiner performance is being monitored, linear regression or piecewise linearization of data points representing its performance over time is performed in step 128 and the result is compared against the threshold or baseline. If the result is less than the threshold or baseline, thus indicating degrading refiner performance due to plate wear and not due other anomalies, step 126 is executed and a recommendation is made that one or more refiner plates 36 and/or 38 be replaced.

In one preferred embodiment, data from the aforementioned refiner sensors, 90, 92, 94, 96, 98 and 100, including real time data, is polled or inputted and stored periodically, preferably every so often or at each occurrence of a minimum increment of time. One example of a specific minimum increment of time is each refiner monitoring cycle. Another example of a specific minimum increment of time is at least about every two hours. If desired, the monitoring cycle can be made to substantially coincide with this minimum increment of time.

In performing step 128, a set of stored refiner quality data is retrieved and regression or piecewise linearization is performed on a set of data of at least the most recent twenty hours of refiner operation. In one preferred implementation, the set of data analyzed pertains to at least about the most recent fifty hours of refiner operation and no more than about the most recent two hundred hours of refiner operation. Preferably, the set of data analyzed pertains to at least about the most recent one hundred hours of refiner operation. Such a preferred range of time is not mere design choice but rather ensures that operating data noise, such as fluctuations in refiner performance not likely attributable to plate wear, are filtered out so that any slope derived from such operating data can be relied upon with confidence to determine whether performance changes are indeed due to plate wear.

As refiner plates 36 and/or 38 or screen plates 40 wear out, the slope of a straight line, such as lines 134 or 138, fitted to the data varies over the time. The method of the invention substantially continuously fits a straight line to the data it processes and stores, such as during each monitoring cycle, and from the slope of the line enables an estimate to be made of when the plates need to be changed. It is important that this estimate be substantially continuously updated during operation of the apparatus since, depending on plate wear and other factors not related to plate wear, it will change. The estimate results in recommendation that a plate be changed when the presently-determined slope of the line changes a sufficient amount over a minimum window of time as compared to a previously-determined threshold that comprises a baseline slope of data taken when the plate was first installed. The plate change can also be made when the presently determined slope is compared to a previously determined slope, such as the slope calculated during the most recent monitoring cycle. If desired, the presently determined slope can be compared against a threshold slope that can be user defined and which can vary from apparatus to another. In this manner, the threshold that triggers plate replacement can be tailored for the operating characteristics of a particular refiner or filter screen.

For a data set of N data points $(x_i,y_i)$, such as is depicted in FIGS. 6 and 7, where $x_i$ is in the time domain and $y_i$ is a quality parameter related to the apparatus being monitored, the data points are approximated by a straight line model:

$$y(x)=y(x;a,b)=a+bx$$

where b is the slope. Assuming that the uncertainty, $\sigma_i$, associated with each $y_i$ is known, and that the $x_i$ are known exactly, it can then be measured how well the model agrees with the data according to:

$$X^2(a,b)=\sum_{i=1}^{N}\left(\frac{y_i-a-bx_i}{\sigma_i}\right)^2$$

Variables that can be used for evaluation of plate performance using the method of the invention can be pulp quality variables, such as tensile and tear indices, and/or process measurements, such as hydraulic load and valve openings. Examples of variables that can be used for evaluation using the method of the invention include quality, tensile index, tear index, fiber length, shive content, shive removal, freeness, bulk, and fiber distribution. Other variables can also be used including process, axial thrust load (refiner), cleanliness (filter screen), contaminant removal or efficiency (filter screen), specific energy, disk gap (refiner), dilution, amount of generated steam, i.e. valve openings (refiner), amount of long fiber, fiber fractionation, vibration, as well as the pressure differential of the stock across the apparatus. The data for one or more of these variables can be obtained from lab results or from real-time inline measurements being taken periodically or continuously during apparatus operation.

When the slope, b, of the fitted line becomes steeper than a predetermined threshold, such as was previously discussed, the method of the invention will result in a recommendation that the plate be changed. The method also is, in effect, predictive in that the data evaluated can be used to extrapolate about when in time performance will likely degrade to less than what is desired for acceptable performance.

In some instances, two or more of the aforementioned variables can be evaluated at the same time using the method of the invention to ensure that an accurate judgement is made of when plate wear is or will become so great as to require plate replacement. For example, the tensile index and the change in the disk gap for a particular refiner may both be monitored and analyzed to determine when the plate should be changed. By simultaneously evaluating two variables, a double-check or failsafe preferably results that provides greater confidence that a plate change recommendation is accurate.

To, in effect, filter the data to minimize the impact of variations in the monitored variable or variable(s) attributed to transient variations in performance, the set of data points analyzed extends over a period of at least about twenty hours of operation where a refiner is being monitored, and over a period of at least about four hours of operation where a filter screen is being monitored. In another preferred method of filtering the data, the data may be periodically stored over greater lengths of time rather than continuously stored. For example, while between one and fifteen measurements of each of the above-discussed variables are made during each day of operation, a pair of measurements each day, a single measurement per day, per two days, or per week may be stored for analysis.

Therefore, linear regression or piecewise linearization preferably is performed on the data set to obtain the slope, b, of a line fitted to the data set of a particular apparatus. In one preferred implementation, if the slope, b, becomes negative, a plate change recommendation 126 is made. In another preferred implementation, if the slope, b, changes more than about 10% from the threshold, a plate change recommendation is generated. For example, if the slope, b, changes more than about 10% from a baseline slope measurement or from the slope of the most recent slope determination, the plate change recommendation is made.

For a refiner 32, a plate change recommendation preferably is generated if the slope, b, is not within about 20% of the threshold. In one preferred implementation of the method, a plate change recommendation is made for a refiner if its slope, b, changes more than about 20% in any given one hundred-hour period of operation.

For a filter screen, a plate change recommendation is made if the slope changes more than about 10% from the threshold. For example, in a preferred implementation of the method of this invention, a plate change recommendation is made for a filter screen if the slope, b, changes more than about 10% in any given eight-hour or ten-hour period of operation. If desired, the threshold can be the slope for the previous eight period of operation. If desired, the monitoring period can be as little as four hours. A relatively short period is desired because, although screen plates last longer than refiner plates, performance of a screen plate degrades at a far more rapid rate once it begins degrading. This is believed to be because it takes a very long time for the protective coating on a screen plate to wear off and expose the base metal underneath. Failure and hence performance degradation typically is rapid once the coating wears off.

Where filter screen performance is being monitored, linear regression of data points representing its performance over time is performed in step 128 and the result is compared against the threshold. If the result is less than the threshold, thus indicating reduced filter screen performance due to plate wear and not other anomalies or transient conditions, step 126 is executed and a recommendation that one or more screen plates 40 be replaced is made.

In one preferred embodiment, data from one or more of the aforementioned filter screen sensors, 102, 104 and 106, is measured to obtain quality and the quality is stored preferably at specific increments of time. One example of a specific increment of time is each monitoring cycle. Another example of a specific increment of time is at least about every hour.

In performing the step 128, a set of stored data is retrieved for a predetermined number of hours of filter screen operation and regression, such as piecewise linearization, is performed on the data set. In one preferred implementation, the set of data analyzed is for at least about the most recent four hours of filter screen operation and preferably no more than about the most recent ten hours of refiner operation. In another preferred implementation, the set of data retrieved is for at least about the most recent four hours of filter screen operation and preferably no more than about the most recent eight hours of refiner operation. Such a small window of time preferably enables the beginning of rapid performance decline to be detected so the plate 40 of the filter screen 34 can be changed before performance adversely affects fiber product quality.

Preferably, linear regression is performed on the data set to obtain the slope, b, of a line fitted to the data set. In one preferred implementation, if the slope, b, of the fitted line is negative, a plate change recommendation 126 is generated. In another preferred implementation, if the slope, b, of the fitted line changes more than about 10% from a threshold slope, the plate change recommendation is generated.

Figure 8A:
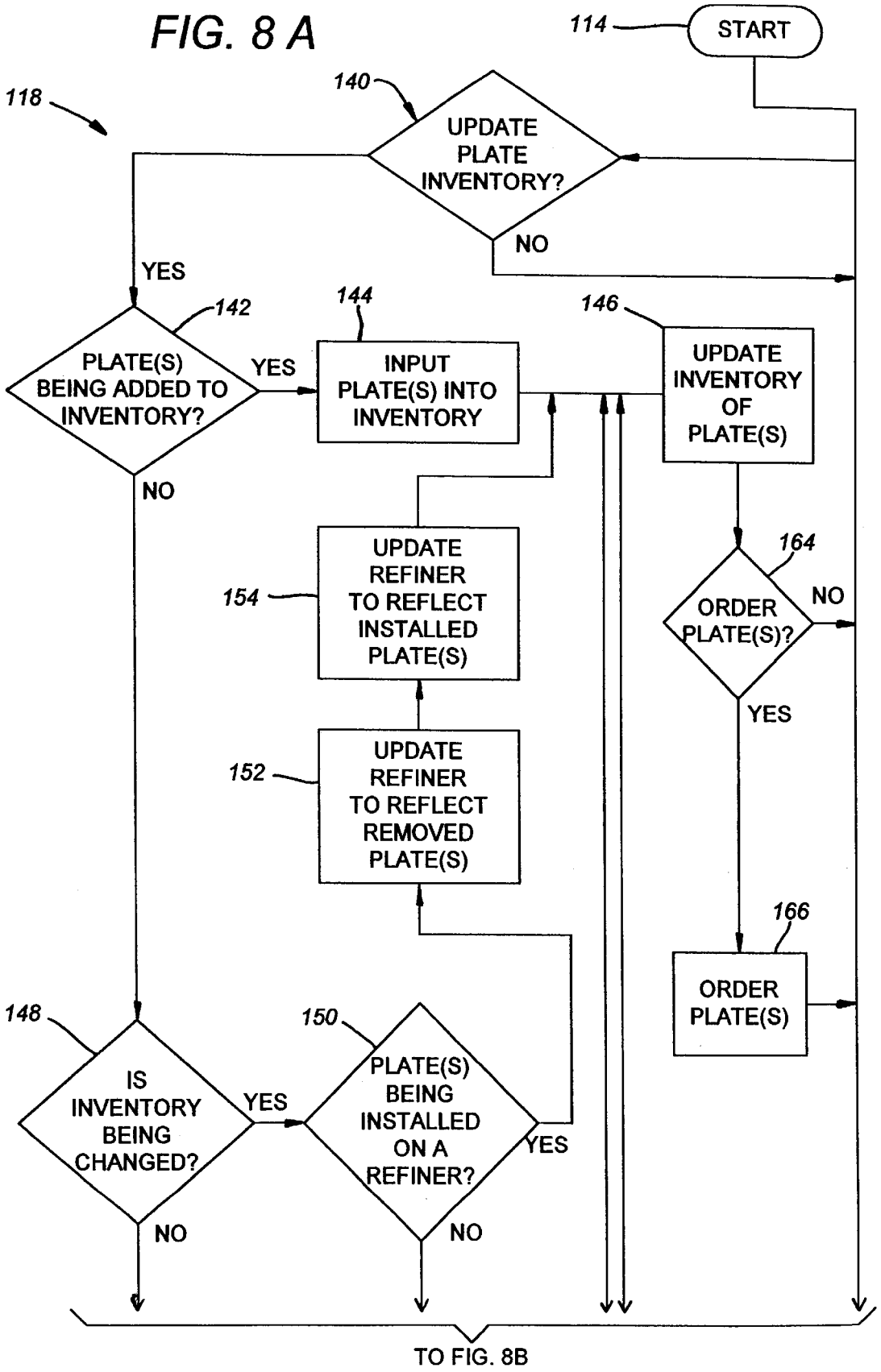
FIGS. 8A, 8B and 9 are flowcharts of a method of inventory management.
Figure 8B:
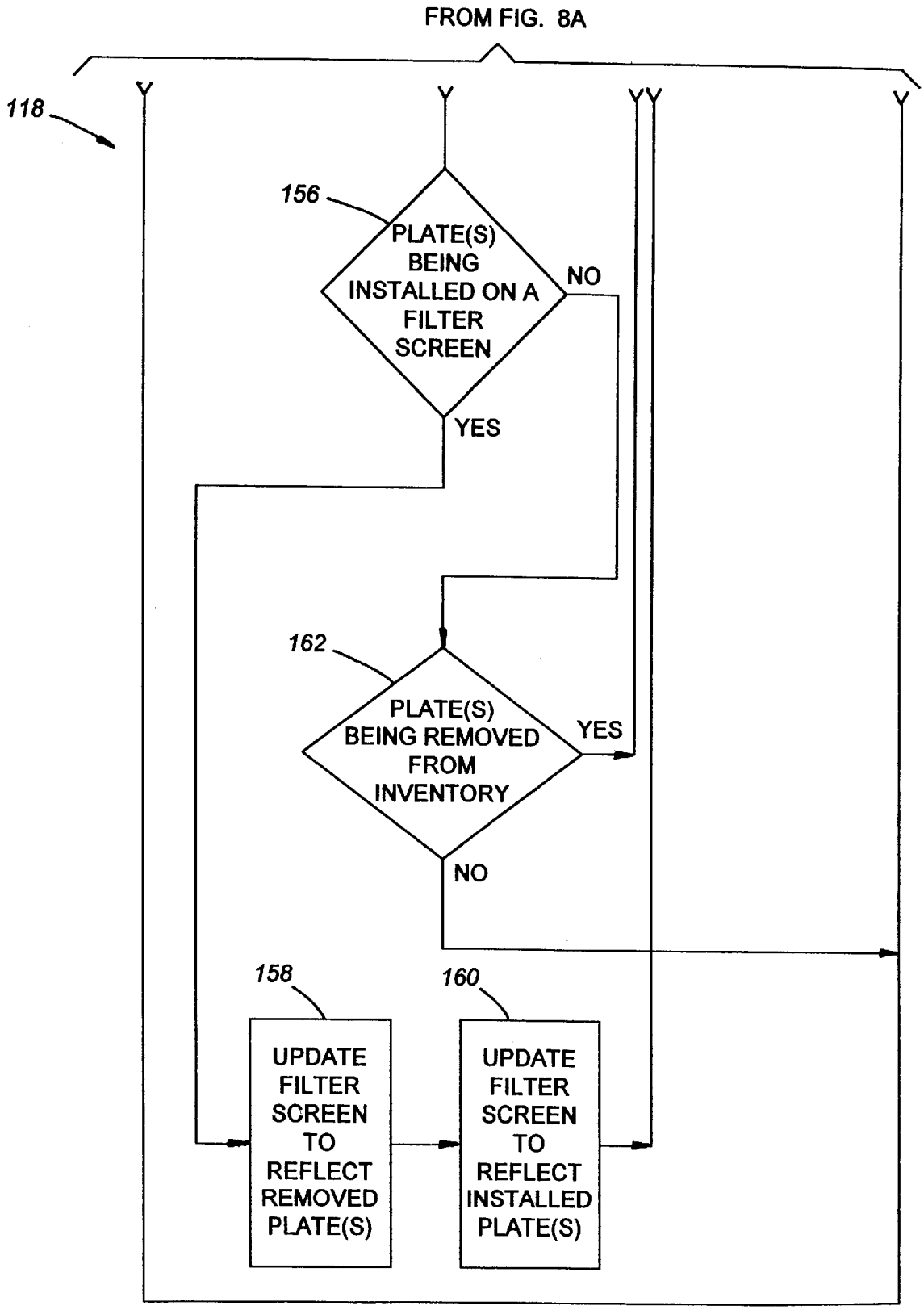

Another branch of the program, the inventorying branch 118 is flowcharted in more detail in an exemplary manner in FIGS. 8A and 8B. Where it is desired to update the inventory, such as in step 140, it is determined whether or not plates are being added to the inventory 142. The inventory preferably is kept in the form of a computer-readable file that preferably is a database file capable of being stored by a storage device. One preferred example of such a file is an open-database connectivity (ODBC) database file that advantageously enables the inventory database file to be read by other software programs and computers other than the host computer 46. By its implementation, a preferred method of this invention is capable of inventorying at least a plurality of pairs of plates, is capable of keeping track of the plates 36 and 38 installed on a plurality of pairs of refiners 32, is capable of keeping track of one or more screen plates 40 installed on a plurality of pairs of filter screens 34, and is capable of keeping track of such data for refiners 32 and filter screens 34 located at two or more different fiber processing/fiber product manufacturing plants.

If it is determined that plates are to be inputted into the inventory in step 144, the inventory is updated in step 146 by adding the plates to the inventory. Preferably, the database is constructed to keep track of plates by whether the plate is for a refiner 32 or filter screen 34 as well as by plate manufacturer and model. Preferably, such database information can be shown on the display 52 or printed.

Where plates are not being added to the inventory but the inventory is being changed 148, it is determined, as is indicated by reference numeral 150, whether plates were installed on a refiner 32 or on a filter screen 34. If refiner plates 36 and/or 38 have been installed on a refiner 32, a record for the particular refiner 32 is updated, as indicated by reference numeral 152, to reflect the refiner plate or refiner plates removed from the refiner 32, and, as indicated by reference numeral 154, to reflect the plate or plates installed on the refiner 32. Thereafter, the inventory can be updated 146 preferably by updating and, if desired, saving the inventory database file.

Where the inventory is being changed by changing screen plates of a filter screen 34, such as is indicated in FIG. 8B by reference numeral 156, a record for the particular filter screen is updated, as indicated by reference numeral 158, to reflect the screen plate 40 or screen plates 40 removed from the filter screen 34, and, as indicated by reference numeral 160, to reflect the screen plate 40 or screen plates 40 installed on the filter screen 34. Thereafter, the inventory can be updated 146 preferably by updating and, if desired, storing the inventory database file.

In a preferred implementation of the method of this invention, to indicate that a plate has been put onto a particular refiner 32 or filter screen 34, a pointing device is used to drag an icon of the plate from its inventory location over the particular refiner 32 or filter screen 34 where the plate was installed. Thereafter, the record for the particular refiner 32 or filter screen 34 is automatically updated to reflect the plate installed and the plate removed. Preferably, the plate removed automatically is transferred to another record that indicates the removed plate is no longer in use and is no longer part of the inventory. This record can be accessed through an icon, such as a garbage bin icon or the like, to enable an operator to see what plates have been removed from use and hence removed from inventory.

If for some other reason the inventory is being changed without installing a plate on a refiner 32 or a filter screen 34, it is determined, as is indicated by reference numeral 162, whether the plate selected from inventory is to be removed from the inventory. If so, the inventory is updated 146 by removing the selected plate and the inventory database file preferably is stored. However, if it is determined that no plate is being removed from inventory, the inventorying branch 118 is exited.

As is shown in FIG. 8A, it is determined, as is indicated by reference numeral 164, whether inventory levels require replacement plates to be ordered. If so, as indicated by reference numeral 166, an order is placed for replacement plates. If desired, after ordering has been completed, the inventorying branch 118 preferably can be exited.

Figure 9:
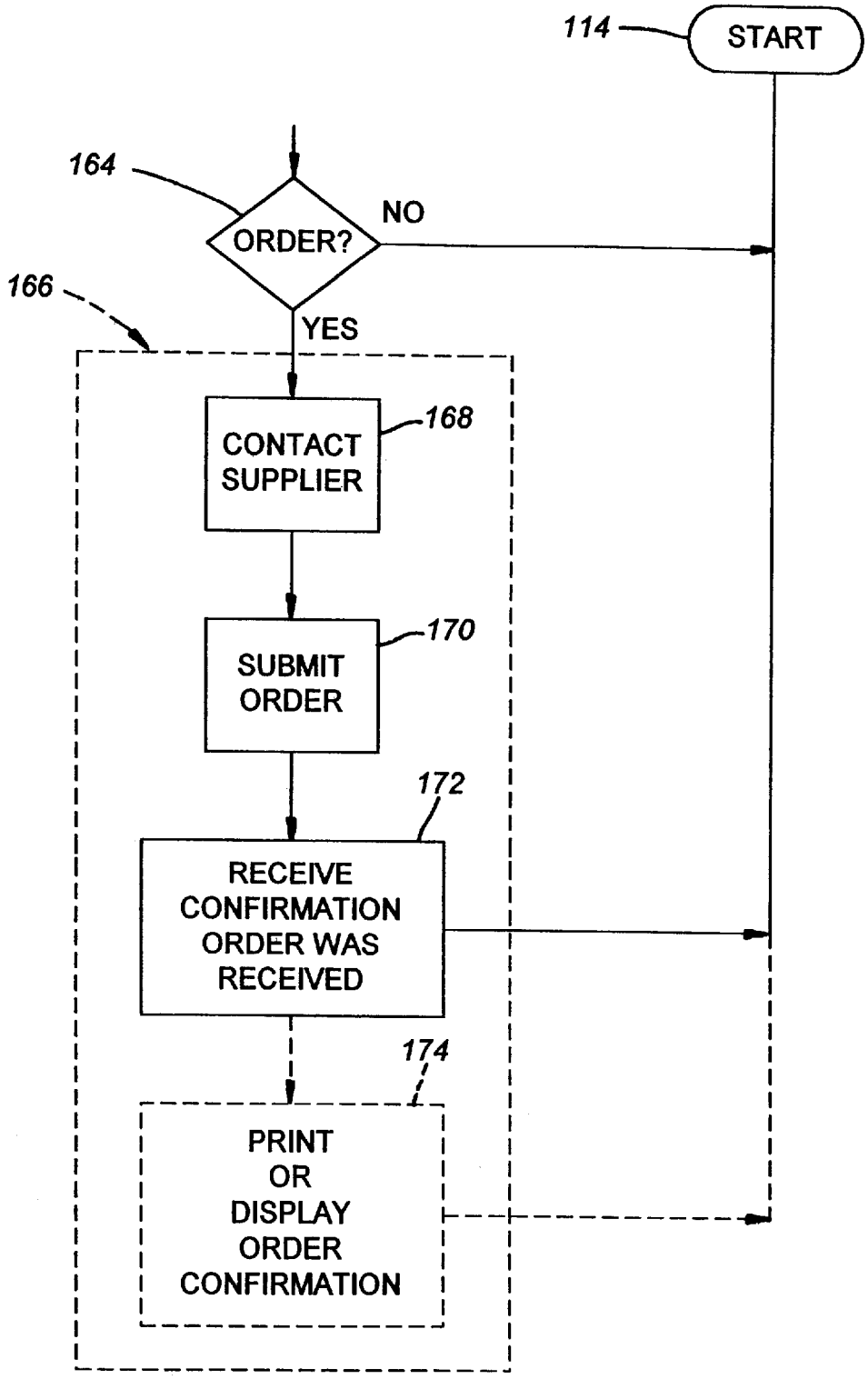

One preferred implementation of a method of this invention for ordering plates is depicted by the flowchart of FIG. 9. If it is determined that replacement plates are needed 164, the supplier is contacted 168, preferably using link 62, and the plate order is submitted 170 by the host computer 46. Thereafter, order confirmation 172 from the supplier preferably is received by the host computer 46 from the supplier computer 64.

If desired, as is indicated by reference numeral 174, the supplier order confirmation can be displayed on the host computer 46 or printed by a printing device or another display in communication with the host computer 46. In a preferred implementation of a method of this invention, the link 62 is a telecommunications link with the plate order 170 sent by e-mail or preferably by an FTP link. Preferably, the order confirmation 172 is received in a like manner. Monitoring of each linked apparatus can and preferably does continue throughout inventory management and ordering.

In a preferred implementation of a method of this invention, ordering 166 is automatically performed after a change to inventory is made that requires the inventory to be replenished. Link 62 preferably is established through a modem or another similar device connected to the host computer 64 dialing up and establishing an FTP connection and submitting the order 170 by e-mail or by direct FTP contact with a website of the supplier, represented by supplier computer 64. In this manner, the plate inventory can be advantageously be managed in a near real time manner.

In another preferred embodiment of the invention, each plate of the inventory and each apparatus are graphically displayed as an icon in a screen or window of the program. When a plate is installed on a particular apparatus, the icon representing that specific plate is dragged over the icon of the particular apparatus to automatically update 154 or 160 a record for that apparatus of what plate or plates were installed on the apparatus. The plate installed is automatically removed from inventory 146 and the plate removed from the apparatus is automatically removed from the record associated with the apparatus 152 or 158. The inventory is then reviewed to determine if additional plates are needed 164. If additional plates are needed, a link 62 is established with a computer or website of the supplier 64 and an order is placed 166 using the link 62 through an FTP connection or by e-mail. Where one supplier supplies refiner plates 36 and 38 and another supplier supplies screen plates 40, the preferred implementation of the method contemplates automatically ordering in the above-described manner refiner plates 36 and 38 from the one supplier and screen plates 40 from the other supplier. In fact, the method of the invention contemplates providing the capability to order in an automated fashion refiner plates 36 and 38 from more than one supplier and screen plates 40 from more than one supplier.

It is also to be understood that, although the foregoing description and drawings describe and illustrate in detail preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A method of monitoring a plurality of fiber processing apparatuses in a fiber processing plant or fiber product manufacturing plant that each have a replaceable component that contacts stock containing pulp fiber during operation and that each comprise a sensor that provides data relating to fiber processing apparatus operation, the method comprising:

(a) obtaining data from each one of the fiber processing apparatuses;

(b) analyzing the data; and (c) determining whether to generate a recommendation to replace the replaceable component for each one of the fiber processing apparatuses.

2. The method according to claim 1 the sensor of each one of the fiber processing apparatuses is linked to a processor that performs steps (b) and (c).

3. The method according to claim 1 wherein during step (b), the data is processed to obtain a result, and during step (c), the result is compared to a threshold.

4. The method according to claim 1 wherein during step (b), the data is processed to obtain a result, and during step (c), the result is compared to a threshold and a recommendation to replace the replaceable component for that particular one of the fiber processing apparatuses is generated if the result is less than the threshold.

5. The method according to claim 1 wherein during step (b), a set of the data is processed to fit a line thereto that has a slope, and during step (c), the fitted line is compared against a baseline established from prior data taken after the replaceable component of a particular one of the fiber processing apparatuses is installed in the fiber processing apparatus.

6. The method according to claim 1 wherein during step (b), a set of the data is processed to fit a line thereto that has a slope, and during step (c), the fitted line is compared against a baseline established from prior data taken after the replaceable component of a particular one of the fiber processing apparatuses is installed in the fiber processing apparatus and a recommendation to replace the replaceable component is generated if the slope of the fitted line is less than the slope of the baseline.

7. The method according to claim 1 wherein during step (b), a set of the data is processed to fit a line thereto that has a slope, and during step (c), the fitted line is compared to a baseline established from a prior set of data taken after the replaceable component was installed in one of the fiber processing apparatuses and a recommendation to replace the replaceable component for the fiber processing apparatus is generated if the slope of the fitted line changes more than ten percent from the slope of the baseline.

8. The method according to claim 1 wherein during step (b), a set of the data is processed to fit a line thereto that has a slope, and during step (c), the fitted line is compared to a baseline established from a prior set of data taken after the replaceable component was installed in one of the fiber processing apparatuses and a recommendation to replace the replaceable component for the fiber processing apparatus is generated if the slope of the fitted line changes more than ten percent from the slope of the baseline where the fiber processing apparatus is a filter screen.

9. The method according to claim 1 wherein during step (b), a set of the data is processed to fit a line thereto that has a slope, and during step (c), the fitted line is compared to a baseline established from a prior set of data taken after the replaceable component was installed in one of the fiber processing apparatuses and a recommendation to replace the replaceable component for the fiber processing apparatus is generated if the slope of the fitted line changes more than twenty percent from the slope of the baseline.

10. The method according to claim 1 wherein during step (b), a set of the data is processed to fit a line thereto that has a slope, and during step (c), the fitted line is compared to a baseline established from a prior set of data taken after the replaceable component was installed in one of the fiber processing apparatuses and a recommendation to replace the replaceable component for the fiber processing apparatus is generated if the slope of the fitted line changes more than twenty percent from the slope of the baseline where the fiber processing apparatus is a rotary disk refiner.

11. The method according to claim 1 the sensor of each one of the fiber processing apparatuses is linked to a computer that performs steps (b) and (c) and that also keeps track of an inventory of replaceable components, and the step further comprising updating the inventory if one of the replaceable components is changed.

12. A method of monitoring a plurality of fiber processing apparatuses that each have a replaceable component that contacts stock containing pulp fiber during operation and that each have a sensor that is linked to a processor, the method comprising:

(a) communicating data from the sensor of each one of the apparatuses to the processor;

(b) analyzing the data using the processor; and (c) determining whether to generate a recommendation to replace the replaceable component for each one of the fiber processing apparatuses using the processor.

13. A method of monitoring a fiber processing apparatuses that has a replaceable component that contacts stock containing pulp fiber during operation and that comprises a sensor that provides data relating to fiber processing apparatus operation, the method comprising:

(a) obtaining data from the sensor;

(b) analyzing a set of the data to fit a curve thereto; and (c) determining whether to generate a recommendation to replace the replaceable component for each one of the fiber processing apparatuses by comparing the fitted curve against a baseline established from prior data taken after the replaceable component of a particular one of the fiber processing apparatuses is installed in the fiber processing apparatus.

14. The method according to claim 13 further comprising a computer that is linked to the sensor, wherein the fitted curve comprises a fitted line that is fitted to the set of data using linear regression, and wherein steps (b) and (c) are performed by the computer.

15. A method of monitoring a fiber processing apparatus that has a replaceable component that contacts stock containing pulp fiber during operation and comprising a sensor that is linked to a computer, the method comprising:

(a) monitoring operation of the fiber processing apparatus until a decrease in performance occurs;

(b) analyzing the change in performance to determine whether the decrease in performance is due to wear of the replaceable component; and (c) generating a recommendation to replace the replaceable component if the decrease in performance is determined to be due to wear.

16. A method of monitoring a plurality of fiber processing apparatuses that each have a replaceable component that contacts and processes stock containing pulp fiber during operation, the method comprising:

(a) providing a computer used to keep track of an inventory of replaceable components;

(b) obtaining data from each one of the fiber processing apparatuses;

(c) analyzing the data;

(d) determining whether to generate a recommendation to replace the replaceable component for each one of the fiber processing apparatuses; and (e) updating the inventory if one of the replaceable components is changed.

17. The method according to claim 16 wherein the plurality of fiber processing apparatuses are both located in a common fiber processing plant or a common fiber product manufacturing plant and, after step (e), the computer sending a replaceable component order via an Internet link to a location remote from the fiber processing plant or fiber product manufacturing plant.

18. A method of monitoring a plurality of fiber processing apparatuses in a fiber processing plant or fiber product manufacturing plant that each have a replaceable component that contacts and processes stock containing pulp fiber during operation, the method comprising:

(a) providing a computer used to keep track of an inventory of replaceable components;

(b) updating the inventory using the computer when one of the replaceable components is installed in one of the fiber processing apparatuses;

(c) determining whether an additional replaceable component needs to be added to the inventory using the computer; and (d) sending an order using the computer for the additional replaceable component via an Internet link to a location remote from the fiber processing plant or fiber product manufacturing plant if an additional replaceable component needs to be added to the inventory.

19. The method according to claim 18 wherein one of the plurality of fiber processing apparatuses comprises a refiner using a replaceable component in the form of a refiner plate or portion thereof, the other one of the plurality of fiber processing apparatuses comprises a filter screen using a replaceable component in the form of a screen cylinder or portion thereof, during step (b) a refiner plate inventory is updated when a refiner plate or portion thereof is installed in the refiner and a perforate screen inventory is updated when a perforate screen or portion thereof is installed in the filter screen, during step (c) it is determined whether an additional refiner plate or portion thereof or an additional perforate screen or portion thereof needs to be added to one of the inventories, and during step (d) an order is sent for at least one of an additional refiner plate or portion thereof and an additional perforate screen or portion thereof.

20. The method according to claim 18 wherein the plurality of fiber processing apparatuses each comprises a refiner using a replaceable component in the form of a refiner plate or portion thereof, during step (b) the inventory is updated when a refiner plate or portion thereof is installed in one of the refiners, during step (c) it is determined whether an additional refiner plate or portion thereof needs to be added to the inventory, and during step (d) an order is sent for at least one additional refiner plate or portion thereof.

21. The method according to claim 18 wherein one of the plurality of fiber processing apparatuses each comprise a filter screen using a replaceable component in the form of a screen cylinder or portion thereof, during step (b) the inventory is updated when a perforate screen or portion thereof is installed in one of the filter screens, during step (c) it is determined whether an additional perforate screen or portion thereof needs to be added to the inventory, and during step (d) an order is sent for at least one additional perforate screen or portion thereof.

22. The method according to claim 18 wherein a host computer is located at the location remote from the fiber processing plant or fiber product manufacturing plant, and, after step (d) the host computer provides confirmation of receipt of the order.

23. The method according to claim 18 further comprising providing a sensor for each fiber processing apparatus that provides data relating to fiber processing apparatus operation and the steps further comprising (1) obtaining data from each one of the fiber processing apparatuses, (2) analyzing the data, and (3) determining whether to generate a recommendation to replace the replaceable component for at least one of the fiber processing apparatuses.

24. The method according to claim 18 further comprising providing a sensor for each fiber processing apparatus that provides data relating to fiber processing apparatus operation and that is linked to the computer, and the steps further comprising (1) obtaining data from each one of the sensors, (2) analyzing the data, and (3) determining whether to generate a recommendation to replace the replaceable component for at least one of the fiber processing apparatuses.

* * * * *